United States Patent [19]

Holtz

[11] 3,985,327

[45] Oct. 12, 1976

[54] ROTATABLE HANGING DEVICE WITH OPENABLE SUSPENSION MEMBER

[75] Inventor: Leonard Holtz, Oceanside, N.Y.

[73] Assignee: Turn-Up, Inc., Oceanside, N.Y.

[22] Filed: Apr. 4, 1975

[21] Appl. No.: 557,961

Related U.S. Application Data

[63] Continuation-in-part of Ser. No. 491,819, July 25, 1974, Pat. No. 3,957,242.

[52] U.S. Cl. ..... 248/318

[51] Int. Cl.[2] ..... F16M 13/00

[58] Field of Search ..... 248/58, 62, 304, 307, 248/318, 323, 324, 339, 340, 342, 343

[56] References Cited

UNITED STATES PATENTS

| | | | |
|---|---|---|---|
| 649,270 | 5/1900 | Collins | 248/62 X |
| 815,019 | 3/1906 | Kampp | 248/339 |
| 841,945 | 1/1907 | Doughty | 248/339 |
| 851,505 | 4/1907 | Ernst | 248/62 X |
| 1,548,128 | 8/1925 | Fisher | 248/304 |
| 1,796,428 | 3/1931 | Austin | 248/58 X |
| 1,966,899 | 7/1934 | McCabe | 248/62 |
| 2,643,079 | 6/1953 | Pitt | 248/62 |
| 3,167,286 | 1/1965 | Sherburne | 248/62 |

*Primary Examiner*—William H. Schultz
*Attorney, Agent, or Firm*—Flynn & Frishauf

[57] ABSTRACT

A rotatable hanging device comprises a main member having a substantially central bore therethrough which is adapted to receive a screw, or the like, for rotatably mounting same to a horizontal surface, such as a ceiling. An elongated generally U-shaped suspension member depends from and extends downwardly from the main member. The suspension member is selectively openable by means of a latch or lock mechanism to permit an object to be hung to pass therethrough.

13 Claims, 5 Drawing Figures

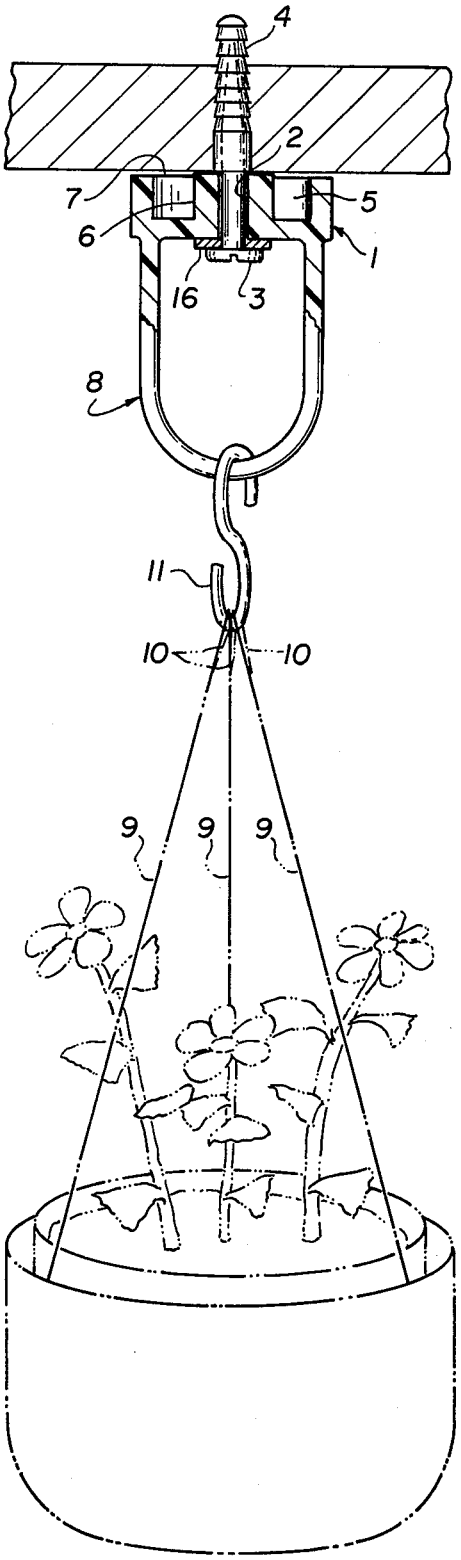
FIG.1
FIG.2
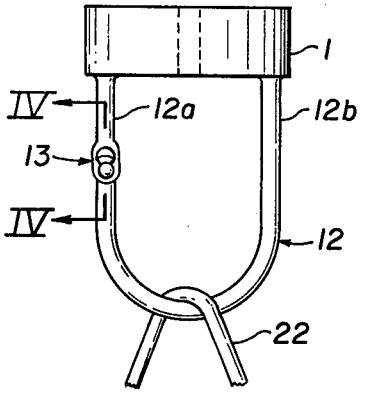
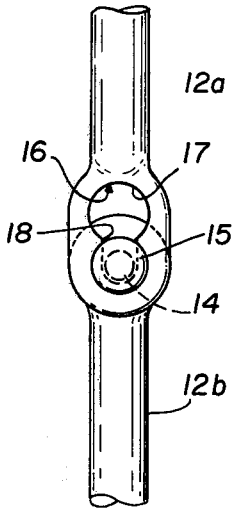
FIG.3
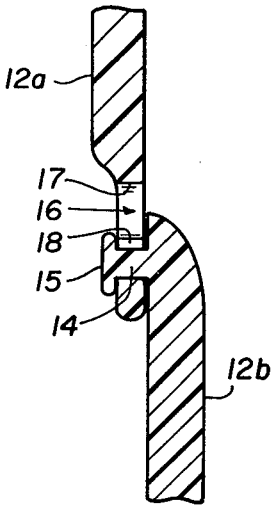
FIG.4
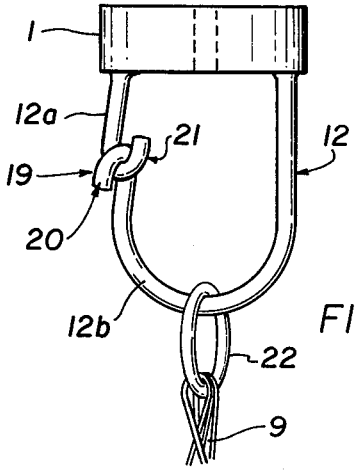
FIG.5

ROTATABLE HANGING DEVICE WITH OPENABLE SUSPENSION MEMBER

CROSS REFERENCE TO RELATED APPLICATION

This is a continuation-in-part of my prior application Ser. No. 491,819, filed July 25, 1974, now U.S. Pat. No. 3,957,242, issued May 18, 1976.

BACKGROUND OF THE INVENTION

This invention relates to hanging devices, and more particularly to a rotatable hanging device.

Hanging devices for hanging an object from a substantially horizontal surface such as a ceiling or the like are known. However, in many instances, it is desired to hang an object from a ceiling while also allowing the object to be rotatable. This is particularly important when hanging plant baskets from the ceiling so that the plant can be rotated in order to successively expose the complete circumference of the plant to a light, for example, light coming in from a window.

The object of the present invention is to provide a rotatable hanging device which is attractive, simple in construction, inexpensive to manufacture and easy to use.

A further object of the present invention is to provide a rotatable hanging device which is suitable for use with substantially any type of object to be hung without requiring the use of "S" hooks or the like.

SUMMARY OF THE INVENTION

In accordance with the present invention, a rotatable hanging device comprises a main member having a bore therethrough for the passage of a mounting member through the bore with a clearance therebetween. A generally U-shaped suspension member depends from the main member and extends downwardly therefrom, the suspension member being attached to the main member symmetrically with respect to the bore and normally defining a or loop with the main member. In order to permit an object to be hung to be inserted through the or loop defined by the suspension member and the main member, the suspension member includes means for selectively opening and closing the normally or loop to permit passage of the object to be hung therethrough. After passage of the object to be hung, the or loop is closed to retain same and to provide a balanced rotatable hanging device.

BRIEF DESCRIPTION OF THE DRAWING

FIG. 1 is a cross-sectional view of a device according to my prior application Ser. No. 491,819 installed in a ceiling;

FIG. 2 is a side view of one embodiment of the present invention;

FIG. 3 is a partial view of the embodiment of the locking mechanism on an enlarged scale;

FIG. 4 is a partial sectional view of the embodiment of FIG. 2, on an enlarged scale; and FIG. 5 is a side view of a further embodiment of the present invention.

DETAILED DESCRIPTION OF PREFERRED EMBODIMENTS

Referring to FIG. 1 a rotatable hanging device according to my prior application Ser. No. 491,819 includes a main substantially disk-shaped member 1 having a central bore 2 therein. A screw 3 extends through the central bore for fastening the hanging device to a substantially horizontal surface, such as a ceiling, overhang, or the like. A washer 16 may optionally be provided to provide a larger bearing surface for the screw 3. In cases where the ceiling is plaster or plasterboard, toggle bolts, mollies or plastic anchoring devices (such as the anchoring device in FIG. 1) may be used to provide secure support. Plastic anchoring devices are preferred which tightly engage the screw 3 to prevent the screw from turning when the main member 1 rotates about screw 3.

The main substantially disk-shaped member 1 has a circular recess, groove or depression 5 therein and a generally U-shaped suspension member 8 depends downwardly from member 1. The generally U-shaped suspension member 8 is integrally molded or formed with member 1. The recess 5 is provided in the embodiment of FIG. 1 to reduce the amount of material required and to facilitate a molding process. A boss 6 is provided to prevent damage to the device if the screw 3 is screwed in too tightly. The upper surface 7 of the hanging device that confronts the ceiling is substantially smooth, thereby preventing damage to the ceiling and facilitating rotation of the member 1 about screw 3. The smooth surface also allows the screw 3 to retain the member 1 very close to the ceiling surface, thereby improving the appearance of the device. The recess 5 need not be circular nor unitary. The recess 5 may be divided by reinforcing ribs if desired.

A difficulty with the embodiment of FIG. 1 is that when hanging a plant, or the like, which has a support string, rope, or the like 9 having loops 10 at the upper end thereof, it is necessary to use an "S" type hook 11 interposed between the ropes or strings 9 and the rotating hanging device of the present invention "S" hook of the FIG. 1 embodiment increases the cost of the device and reduces the asthetic appeal thereof. In order to eliminate the "S" hook 11, the embodiments of FIGS. 2–4 have been developed.

Referring to FIG. 2, the substantially disk-shaped main member 1 has a generally U-shaped suspension member 12 integrally formed therewith. Suspension member 12 comprises first and second portions 12*a* and 12*b* which are lockably interconnected by means of a lock mechanism 13 which is better seen in FIGS. 3 and 4 which show the locking mechanism on an enlarged scale.

Referring to FIGS. 3 and 4, member 12b has a projection 14 extending therefrom, the projection 14 having an enlarged head 15 at the end thereof. Member 12a has a keyhole opening 16 therein, the keyhole opening 16 comprising an enlarged opening 17 and a lower smaller opening 18. The enlarged opening 17 is large enough to permit passage of the enlarged head 15 therethrough, the enlarged head 15 locking the members 12*a* and 12*b* in the closed position when the member 12*b* is pulled downwardly to engage the projection 14 in the smaller opening portion 18, the enlarged head 15 locking the members in engagement in the position shown, for example, in FIGS. 3 and 4. It should be clear that the position of the keyhole and projection 14 may be reversed relative to members 12*a* and 12*b*, as desired.

When fabricating the device according to FIGS. 2—4, the suspension member portion 12*b* may be molded so as to provide the portion thereof in the vicinity of the locking mechanism 13 with a natural "spring" in the direction out of the paper with reference to FIGS. 2 and 3 so as to bias member 12*b* in such a position to maintain locking engagement. Moreover, the member 12*b* may be molded offset downwardly so as to further provide a natural spring action in the downward direction so as to naturally retain the projection 14 in the narrow opening section 18 of the keyhole 16.

FIG. 5 shows another embodiment of the invention wherein suspension member 12 has a locking mechanism 19 therein. The locking mechanism comprises a first hook member 20 formed in suspension member portion 12*b* and an oppositely directed hook member 21 formed in suspension member portion 12*a*. As is evident from FIG. 5, the hook members 20 and 21 are selectively engageable to open and close the generally U-shaped suspension member 12. When the device of FIG. 5 is molded of plastic, or the like, the suspension member portion 12*b* is molded offset downwardly from the hook member 21 so as to provide a natural downward spring to maintain the hook members 20 and 21 in positive engagement.

The devices discussed hereinabove are preferably made of plastic materials and are preferably molded as a unitary structure. However, it should be clear that the suspension member 12 may be separately formed and later attached to main member 1.

As seen in FIGS. 2 and 5, when the locking mechanisms 13 and 19 respectively are opened, it is possible to pass an object to be hung, for example including loop member 22, through the opening provided when the lock mechanism is disengaged, and to then engage the lock mechanism to close the suspension member 12.

By virtue of the arrangement of the present invention, a well balanced suspension device is provided which, by virtue of the excellent balance and excellent weight distribution about the screw 3, rotates quite easily responsive to turning of the object which is hung therefrom. A very low torque is requirerd to rotate the suspension member, thereby enabling the rotating hanging device to "follow" the rotation of the object being hung, for example a plant, even when the object is connected to the rotating hanging device only by means of highly flexible rope, strings, or the like.

The shape of the main member 1 need not be disk-shaped. It be may elliptical, square, polygonal, etc. Moreover, the cross-sectional configuration of main member 1 may be varied from that shown in the drawing, to, for example, a hemispherical shaped or any other decorative configuration. Further, the U-shaped member need not take the exact configuration shown in the drawings. It may take any shape or form, as desired, provided that it is secured to the main member 1 so as to provide a balanced loading effect relative to the screw 3 to enable the device to be easily rotatable.

While the above embodiments have been shown by way of example, it should be clear that various other locking mechanisms may be used within the inventive concept as set forth in the appended claims. For example, other types of locking mechanisms may be provided in place of the mechanisms 13 and 19 in the position illustrated in the FIGS., or in substantially any other position relative to the suspension member 12. The above modifications of the present inventive concept are given by way of example only and are not to be construed as limiting the inventive concept as defined in the appended claims.

I claim:

1. A rotatable hanging device adapated to be mounted to a fixed, substantially horizontal mounting surface, comprising:

a main member having a substantially central bore therethrough and having a first bearing surface which is substantially perpendicular to the longitudinal axis of said substantially central bore, said first bearing surface facing said substantially horizontal mounting surface;

an elongated, flexible, generally U-shaped, non-hinged suspension member having at least one leg integrally and non-rotatably connected to said main member, said suspension member extending downwardly from said main member substantially symmetrically about said substantially central bore and normally defining in combination with said main member a closed loop, said suspension member passing through an extension of the longitudinal axis of said substantially central bore, said suspension member includng non-hinged locking means thereon for selectively opening and lockingly closing said normally closed loop to permit passage of an object to be hung through said loop; and stationary mounting means extending through said substantially central bore of said main member for rotatably mounting said main member to said substantially horizontal mounting surface with said first bearing surface adjacent said substantially horizontal mounting surface, said main member being rotatably relative to said stationary mounting means.

2. The device according to claim 1 wherein said axis of said substantially central bore of said main member is substantially parallel with the plane in which said generally U-shaped suspension member lies.

3. The device according to claim 1 wherein said locking means for opening and closing said normally closed path comprises a locking mechanism disposed in an intermediate portion of said generally U-shaped suspension member.

4. The device according to claim 3 wherein said generally U-shaped suspension member includes first and second leg portions integrally extending downwardly from said suspension member, said first leg portion includng a first locking member and said second leg portion including a second locking member selectively engageable with said first locking member to selectively open and close said normally closed loop, said first and second locking members comprising said locking means.

5. The device according to claim 4 wherein said first locking member comprises an opening and said second locking member comprises a projection selectively engagable in said opening.

6. The device according to claim 5 wherein said opening includes a first opening portion and a second opening portion smaller than said first opening portion, and said second locking member includes a projection having an enlarged head at the end thereof, said projection extending from said second suspension member portion, said enlarged head being passable through said first opening portion, but not passable through said second opening portion, said projection being passable through both of said opening portions.

7. A device according to claim 4 wherein said first locking member comprises an upwardly directed hook member and said second locking member comprises a downwardly directed hook member selectively engagable with said upwardly directed hook member.

8. The device according to claim 7 wherein said generally U-shaped suspension member is molded such that said hook members are biased away from each other by the inherent springiness of the material forming said suspension member so as to positively maintain engagement therebetween.

9. The device according to claim 5 wherein at least one of said first and second suspension member portions are biased in such a direction as to maintain engagement of said projection in said second opening.

10. The device according to claim 8 wherein said main member and generally U-shaped suspension member are integrally molded of plastic material.

11. The device according to claim 9 wherein said main member and generally U-shaped suspension member are integrally molded of plastic material, and wherein said generally U-shaped suspension member is molded such that said first and second suspension member portions are spaced away from each other and are relatively biased away from each other by the inherent springiness of the plastic material.

12. The device according to claim 11 wherein said first and second suspension member portions are biased away from each other in a direction substantially parallel to the longitudinal axis of said substantially central bore and also in a direction substantially perpendicular to the longitudinal axis of said substantially central bore.

13. The device according to claim 1 wherein said main member and generally U-shaped suspension member are integrally formed of plastic material.

* * * * *